United States Patent [19]

Stanfield

[11] 4,033,576

[45] July 5, 1977

[54] PAPER FEEDING AND RECEIVING SYSTEMS FOR PRESSES AND DUPLICATORS

[75] Inventor: Jay E. Stanfield, Guymon, Okla.

[73] Assignee: J.I.M. Corporation, Guymon, Okla.

[22] Filed: Nov. 11, 1975

[21] Appl. No.: 631,139

Related U.S. Application Data

[63] Continuation-in-part of Ser. No. 474,975, May 31, 1974, Pat. No. 3,921,970.

[52] U.S. Cl. ..... 271/5; 271/6; 271/9; 271/31; 271/155; 271/198; 271/222; 271/266

[51] Int. Cl.² ..... B65H 5/22

[58] Field of Search ..... 271/9, 5, 6, 12, 30 R, 271/31, 127, 130, 275, 147, 152, 154, 155, 156, 69, 198, 210, 221, 222, 266; 198/203; 226/53

[56] References Cited

UNITED STATES PATENTS

| | | | |
|---|---|---|---|
| 2,530,670 | 11/1950 | Von Hofe | 271/31 |
| 2,746,753 | 5/1956 | Battey | 271/31 |
| 3,921,970 | 11/1975 | Stanfield | 271/107 X |

*Primary Examiner*—Richard A. Schacher
*Attorney, Agent, or Firm*—William R. Laney

[57] ABSTRACT

A paper feeding and receiving system for use on presses and duplicators, such system including a paper feed regulator assembly which has a microswitch mounted on a supporting arm above a vertically reciprocable feed table for sensing the height of papers vertically stacked thereon. An electrically actuated solenoid is mountable on the duplicator or press, and operates in response to closure of the microswitch to actuate a pawl latch lever and mechanical linkage to control and effect the incremental elevation of the paper feed table disposed below the microswitch. The paper feed and receiving system further includes a balance beam subassembly mounted on the paper feed table for supporting dual, horizontally spaced, vertically extending stacks of paper to facilitate simultaneous feeding of two sheets of paper to the press or duplicator. Finally, the system of the invention includes a receiver-conveyor table detachably mounted at the discharge side of the duplicator or press for receiving printed papers from the press and moving such papers to a point of disposition. The receiver-conveyor table includes a plurality of belts and a needle drive mechanism which periodically engages the belts and drives them in reciprocation through a predetermined increment of travel to advance received paper stock deposited on the table from the press toward a location of disposition spaced from the press or duplicator.

28 Claims, 13 Drawing Figures

PAPER FEEDING AND RECEIVING SYSTEMS FOR PRESSES AND DUPLICATORS

RELATED APPLICATIONS

This application is a continuation-in-part of my U.S. patent application Ser. No. 474,975 entitled "Paper Feed Regulating Assembly for Presses and Duplicators" filed May 31, 1974, and now U.S. Pat. No. 3,921,970.

BACKGROUND OF THE INVENTION

1. Field of the Invention

This invention relates to systems utilized on duplicating machines or printing presses for the purpose of effecting and controlling the feed of sheets of paper, envelopes or the like to the printing or duplicating mechanism of the machine or press, and for receiving from the press, such papers or envelopes after completion of the printing, and conveying the printed papers or envelopes in a regular, synchronous and safe fashion to a point spaced from the press where they can be gathered up and packaged or otherwise suitably discharged.

2. Brief Description of the Prior Art

In my copending application Ser. No. 474,975, filed on May 31, 1974, I describe an improved system for sensing and controlling relatively thin sheets of paper fed one-by-one and in sequence from the top of a stack of such materials located on a vertically movable feed table. Such feed tables and systems are, in general, used on presses and duplicating machines. The system disclosed in my copending application improves the reliability of feeding such papers from the top of a stack where the materials fed are a highly compressible stock, such as envelopes and cockle finish onion skin.

In feeding systems of the general type described, a procedure is sometimes followed which is known as "two-up" printing. In this procedure, two side-by-side vertical stacks of relatively narrow stock, such as envelopes, are placed on the feed table and the top items in each of the two stacks are fed simultaneously to the press and are concurrently printed. A problem is encountered in employing this procedure of irregularity or misalignment developing at the tops of the two stacks such that the uppermost sheet or envelope in one stack will be significantly higher than the uppermost sheet or envelope in the other stack. When this occurs mis-feeding results, some of the product is damaged and in many cases, the press or duplicator must be stopped to clear the machine and realign or level the upper surfaces of the two stacks. Thus, although some increase in production is achieved when a press or duplicator is operated in a two-up fashion, such operations are now conducted in a less than optimum mode because of the mis-feeding which often results from misalignment of the upper surfaces of the two stacks.

In presses and duplicating machines of the type here under discussion, the paper stock, after being printed, must be removed from the press or duplicator in a safe manner which allows the operator to handle the product as it is discharged from the press without stopping the press and thus cutting production rates. To facilitate such discharge of product and handling by the operator, various types of conveyors and/or receivers have previously been used on presses and duplicators to receive the printed stock, and move it to a location spaced from the press or duplicator where it can be gathered up by the operator and placed in boxes. In many of these receiver-conveyor devices, conveyor belts are provided upon which the printed paper stock is deposited upon discharge from the press or duplicator, and the belts then move the printed stock to a location where it is automatically overlapped or semi-stacked, ready for the operator to gather it up and place it, in the same order and arrangement as it leaves the press, in suitable containers.

In most of the receiver-conveyor devices of the type described, such apparatus is self-contained, and has a drive motor forming a part of the device and positively driving the rollers which support the conveying belts. In such systems, the receiver-conveyor continues to run when the press is off, and is not synchronized with the press speed unless approximate adjustments are made to approach such synchronization. Because of the inclusion of the motor and the drive mechanism by which the motor is connected to the rollers employed to drive the belts, receiver-conveyors of the type described are generally relatively heavy, and the inclusion of the independent drive therein increases their cost.

Also, in many of the receiver-conveyors used in this way, inadequate guides for the discharged paper stock are provided with the result that some of the sheets discharged from the press waft off of the conveyor belts, or slip to the side and must be picked up by the operator, or straightened out. Further, on occasion, some of the receiver-conveyors employed will become jammed due to an excessive number of sheets being deposited thereon faster than the conveyor can move these to the point of discharge, and such jams require the stopping of the press with a resultant loss in production. Further, the interface which is provided between many of the existing types of receiver-conveyor devices and the mechanism of the press results in jamming at the point of this interface, and operators occasionally attempt to reach into the mechanism to this location for the purpose of removing paper from the location of the jam. This presents a serious safety hazard which is particularly severe on those models of presses and duplicators which employ moving chains and sprockets for the purpose of moving the printed paper stock to the point of the interface between the receiver-conveyor and the printing mechanism.

Another problem which is occasionally encountered with receiver-conveyors of the driven belt type previously used, is that the frictional drive between the belt and the driven roller or rollers around which the belt is passed allows slipping to occur under heavy loads, with a resilient loss of conveying capacity and disfunction of the adjusted synchronism of the receiver-conveyor movement with the speed of operation of the press or duplicator.

Finally, where increased feed rates of paper stock to the press or duplicator are made possible by improved feeding systems of the sort described in my copending patent application, or where such increased production occurs as a result of attempted use of the two-up feeding system, existing receiver-conveyors are frequently incapable of operating consistently and reliably at speeds which are adequate to receive the very rapidly discharging finished stock.

BRIEF DESCRIPTION OF THE PRESENT INVENTION

The present invention is directed to a system for increasing the speed and efficiency with which various types of paper stocks can be fed to printing and duplicating machines, and for receiving such stocks, after printing, and safely conveying them in an orderly and easily handled status to a location spaced from the point of discharge from the printing and duplicating machine. The system is especially useful in the feeding of envelopes, compressible papers or paper articles which are of varying thickness from one side thereof to the other.

The system of the invention effects improvements at several distinct phases of the printing operation. Initially, the system provides a balance beam and stack supporting subassembly mountable on the vertically movable feed table of the press or duplicator. This subassembly, in cooperation with stack-height limiting means carried on the press above the feed table, insures continuous, trouble-free simultaneous feeding of paper stocks from the top side of two vertically spaced stacks in the two-up fashion.

The system also provides a longer lived, more easily adjustable microswitch sensing assembly for detecting the level of the uppermost paper sheet in a stack of paper sheets (or envelopes) to be fed to the press or duplicator, and initiating a signal which actuates the feed table which supports and elevates the stack as the sheets are fed to the press or duplicator. The microswitch sensing assembly broadly comprises a microswitch housing which encloses a microswitch having a movable switch contact. A contactor plate is mounted in the housing and is movable to contact and move the microswitch contact to open and close the microswitch. An actuator needle subassembly is mounted between the feed table which carries the stack of papers to be fed to the press or duplicator and the microswitch assembly. This actuator needle subassembly includes a movable needle which is moved upon contact with the vertically moving stack of papers when the feed table of the press or duplicator is being elevated. The needle moves up into contact with the contactor plate and biases it upwardly so as to move the microswitch contact and close the microswitch. Closure of the microswitch closes an electrical circuit to a solenoid assembly of the general type described in my copending application Ser. No. 474,975 so that further elevation of the feed table is arrested.

Finally, the system of the invention, as used in combination with the printing mechanism of a duplicating machine or press includes a receiver-conveyor assembly which is light in weight, easily and quickly mounted and dismounted from the press or duplicator at the discharge side thereof, and which employs a novel drive system assuring precise synchronism of the conveyor portion thereof with the speed of operation of the press or duplicator, and a longer and more trouble-free operation. Broadly described, the receiver-conveyor assembly includes means supporting a plurality of endless conveyor belts which are positioned to receive envelopes or printed paper stock from the press or duplicator, and to convey these to a remote location for removal by an operator. The assembly further includes a belt driving subassembly which includes an oscillating needle drive structure which carries needles which impale one or more of the belts of the receiver-conveyor assembly during one portion of an oscillating movement imparted to the needles. A kinematic chain is provided between the oscillating needle drive structure and a reciprocating jogger plate forming a portion of the press or duplicator so that the drive may be originated at this jogger plate and transmitted through such kinematic chain to the oscillating needle drive structure. In this way, the conveyor belts are driven incrementally in periodic movement by the oscillating needle drive structure and are retained in perfect synchronism with the speed of operation of the press or duplicator.

It is an important object of the present invention to provide a sensitive microswitch assembly which finely controls the feed of paper sheets to the printing or duplicating machine and contantly controls the extent of elevation of the conventional paper feed table included in such machines so as to improve the efficiency and accuracy of the feeding function of such machines.

Another object of the invention is to provide a sturdily constructed, inexpensive and efficiently functioning paper feed regulating assembly which can be quickly and easily installed on most existing duplicating machines and small printing presses using a vertically reciprocating feed table, for accurately and precisely controlling the feed of individual paper sheets carried in a stack on such feed tables.

Another object of the invention is to provide a paper feed regulating assembly for feeding paper stock, including envelopes, and further including highly compressible papers, to a printing press or duplicating machine, with such feed regulating assembly including a novel balance beam assembly which permits two vertically extending stacks of such paper stock or envelopes to be simultaneously fed through the printing mechanism of the machine without misfeeding or malfunction.

An additional object of the invention is to provide a novel, lightweight receiver-conveyor assembly for receiving sheets of paper or envelopes from a duplicating machine after they have been printed, and conveying them to a location remote from the machine for pickup and removal by the operator of the machine.

An additional object of the invention is to provide a needle driven, incrementally moved belt conveyor assembly upon which printed paper stock can be deposited on discharge from a printing or duplicating machine, the belts of which assembly are moved in perfect synchronism with the speed of such printing or duplicating machine.

A further object of the invention is to provide a lightweight receiver-conveyor for use with duplicating and printing machines which is operated from a moving portion of such machines and therefore does not require a self-contained motor or drive system.

A further object of the invention is to provide a driven belt receiver-conveyor assembly in which moving belts are used to receive and move away from printing and duplicating machines, printed stock discharged from such machines, which belts do not depend upon a friction drive originating with belt supporting rollers around which the belts are passed.

Additional objects and advantages of the invention will become apparent as the following detailed description of certain preferred embodiments of the invention is read in conjunction with the accompanying drawings which illustrate the invention.

DETAILED DESCRIPTION OF PREFERRED EMBODIMENTS OF THE INVENTION

Figure 1:
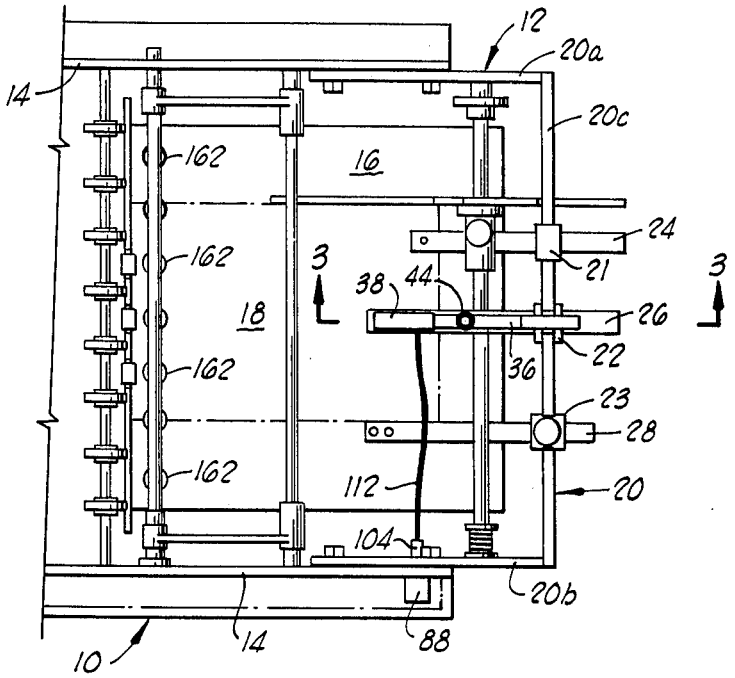
FIG. 1 is a top plan view of a portion of one type of duplicating machine having the paper feed regulating assembly of the present invention mounted thereon.

Referring initially to FIG. 1 of the drawings, shown therein is a base housing 10 which has mounted thereon a framework superstructure 12 which includes a pair of vertically extending side plates 14. For simplification of explanation and better understanding of the present invention, all auxiliary and ancillary structures which are conventionally mounted in the base housing or on the framework superstructure have not been illustrated in FIG. 1, or in the remainder of the drawings of this application, except so much of the structure as is involved in the operation of the present invention.

It will be understood by those skilled in the art that on many types of duplicators, of which the one illustrated in the Figures is typical, the base housing includes a paper storage zone and a paper feed table which has a horizontally extending upper surface for supporting a stack of paper sheets, and which is elevated in increments by appropriate mechanism at proper times to assure continuous feed of the paper to the duplicating portion of the apparatus. A feed table of this general type is represented in FIG. 1 by the schematically illustrated structure 16, and a stack of paper sheets carried thereon is illustrated by the reference character 18. It may be further pointed out, by way of explanation, that the printing rolls and duplicating apparatus, per se, are generally located just to the left of that structure illustrated in FIG. 1, and are mounted by suitable supporting shafts and brackets in the framework superstructure. The printing and duplicating structure, per se, forms no part of the present invention, which is concerned with the paper feed regulating assembly used for feeding paper from one or more stacks of paper sheets carried on the feed table 16 into the printing and duplicating mechanism, and a receiver-conveyor attachable to the printing or duplicating machine for receiving printed paper sheets from the machine.

Adjustably mounted between the vertically extending side plates 14 is a horizontally extending U-shaped supporting bracket 20 which includes parallel arms 20*a* and 20*b* and a transversely extending slide bar 20*c*. Slidably mounted on the slide bar 20*c* by means of clamp structures 21, 22 and 23 are a plurality of elongated plates 24, 26 and 28.

Figure 3:
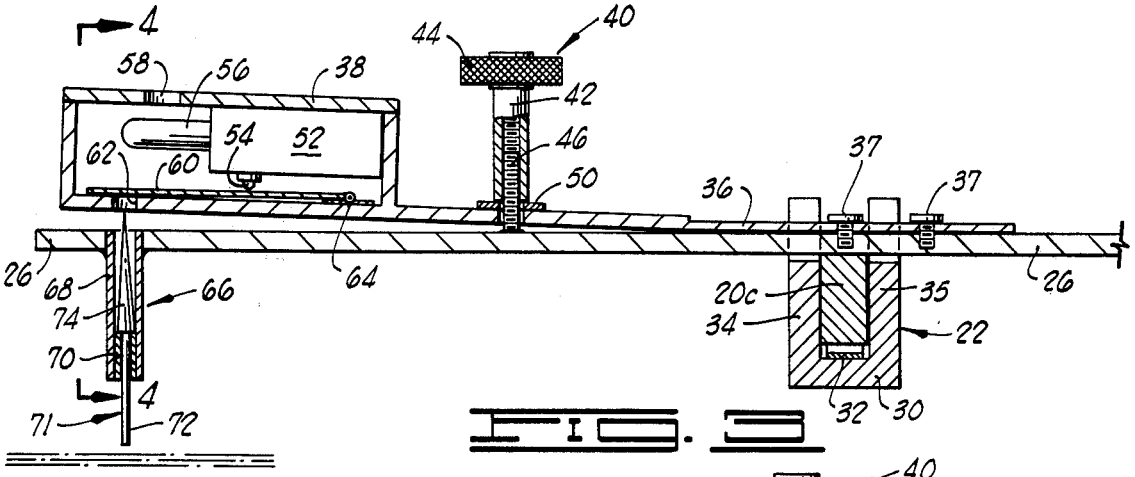
FIG. 3 is an enlarged sectional view taken along line 3—3 of FIG. 1.
Figure 4:
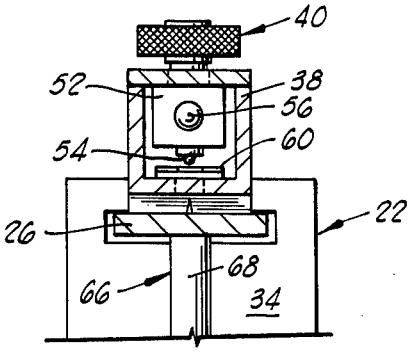
FIG. 4 is a sectional view taken along line 4—4 of FIG. 3.

As shown in FIG. 3 of the drawings, the spring loaded friction clamp 22 includes a U-shaped block 30 having a spring 32 located in the bottom of the channel defined by the U-shaped block, and having the legs 34 and 35 of the U-shaped block slotted at the upper side thereof, as shown in FIG. 4, to facilitate reception of the elongated plate 26. The spring 32 tends to bias the U-shaped block downwardly with respect to the slide bar 20*c* and the plate 26 so that the upper portions of the clamp structure which define the upper side of the slot formed through the legs to receive the plate are drawn into frictional engagement with the side portions of the plate.

An elongated switch plate 36 is constructed of a spring metal and extends over the elongated plate 26. One end portion of the switch plate 36 is secured to the plate 26 by screws 37. At its outer end, the switch plate 36 is secured to, and carries, a switch housing 38, and intermediate its length, the switch plate carries an adjusting screw subassembly 40. The adjusting screw subassembly 40 includes an internally threaded sleeve 42 having a knurled turning knob 44 at the upper side thereof. The sleeve 42 threadedly receives an upwardly projecting externally threaded screw shank 46 which has its lower end secured to the upper side of the elongated plate 26. The sleeve 42 has its lower end in contact with a friction washer 50.

The switch housing 38 is of generally rectangular parallelepiped configuration and encloses an ON-OFF microswitch 52 of the type described in my copending U.S. patent application Ser. No. 474,975, filed May 31, 1974. A microswitch contact 54 projects downwardly from the lower side of the microswitch 52 and an indicator light 56 is mounted within the switch housing 38 on one side of the microswitch in a position to be viewed through an aperture or hole 58 formed in the upper side of the switch housing.

Lying along the upper side of the bottom wall of the switch housing 38 is a contactor plate 60. The contactor plate 60 has one of its end portions overlying a hole 62 formed in the bottom walll of the switch housing 38 and has its other end secured by a piano hinge connection 64 to the inner and upper side of the bottom wall of the switch housing 38. It will thus be perceived in referring to FIG. 3 that the contactor plate 60 can be pivoted upwardly and downwardly about the piano hinge 64 to permit an intermediate portion of the contactor plate 60 to force the switch contact 54 upwardly, or to allow it to move downwardly, in following such pivotal movement.

Mounted near the free end of the elongated plate 26 which is remotely located with respect to the slide bar 20*c* and the clamp 22, is an actuator needle subassembly 66. The actuator needle subassembly 66 includes a downwardly extending tubular member 68 which has its upper end positioned in a mating aperture formed through the outer end of the elongated plate 26. Near the lower end of the tubular member 68, a small insert sleeve 70 provides a stop for limiting the downward movement of an actuator needle 71. The actuator needle includes a stem 72 and a conically shaped head 74. The needle 71 is reciprocably mounted within the tubular member 68 with the stem 72 extending through the insert sleeve 69. The head 74 of the needle 71 is aligned with the hole 62 in the bottom wall of the switch housing 38 so that as the actuator needle 71 moves upwardly, the point of the conically shaped head 74 will contact the contactor plate 60 and pivot it upwardly.

Figure 5:
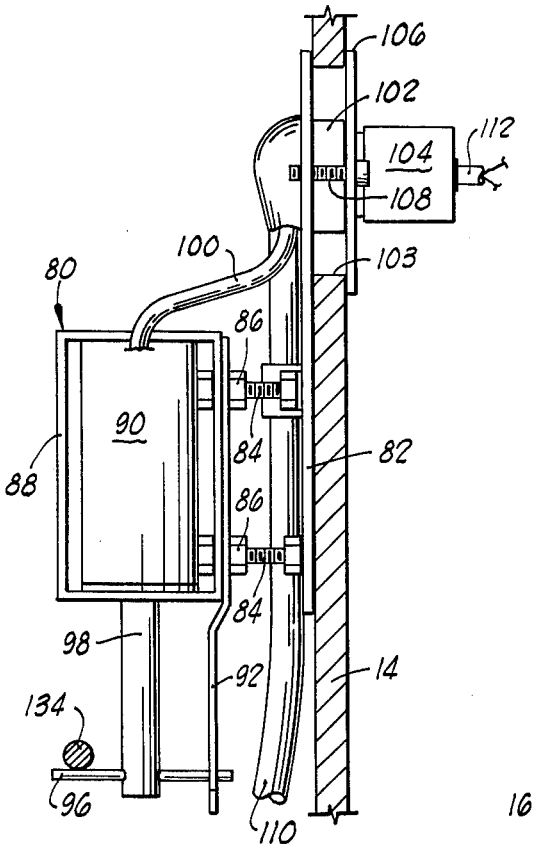
FIG. 5 is a view in elevation illustrating the manner in which a solenoid forming a portion of the present invention is adapted for securement to a side of a duplicating machine in which the paper feed regulating assembly of the invention is to be mounted. A side mounting plate on the machine is illustrated here in section.

As shown in FIG. 5 of the drawings, a solenoid assembly 80 is mounted on one of the vertically extending side plates 14. The solenoid assembly 80 is secured on that side plate of the printing or duplicating machine which carries certain gears, ratchet and pawl mechanisms which are conventionally employed in the actuation of the feed table 16 for incrementally elevating this table to maintain a proper level of the top of the stack 18 of paper sheets for feeding the duplicator or printing press. The solenoid assembly includes an elongated, generally rectangular mounting plate 82 which is secured against the outer side of the side plate 14. Mounting posts 84 projecting from the mounting plate 82 are utilized in conjunction with suitable taps 86 for mounting a solenoid housing 88 in spaced relation to the side plate 14. The coil 90 of the solenoid is mounted inside the solenoid housing 88, and a slotted plunger limit plate 92 is secured to the side of the solenoid housing and projects downwardly therefrom. The plunger limit plate 92 has a central slot 94 provided therein, and this slot receives one end of a transverse key 96 carried on the lower end of the solenoid armature plunger 98. Electric current is supplied to the solenoid coil 90 by a lead 100.

A bushing 102 secured to the mounting plate 82 is mounted in a hole or opening 103 formed in the side plate 14, and is connected to a female socket 104 exposed on the inner side of the vertically extending side plate 14. The solenoid mounting plate 82 is held against the vertically extending side plate 14 by means of a cover plate 106 which covers the opening 103 through the side plate. A pair of threaded screws 108 are projected through the cover plate 106 and into threaded apertures formed in the solenoid mounting plate 82.

A main electrical power supply line 110 is connected through the bushing 102 to the female socket or receptacle 104, and provides electrical power to this socket, as well as to the solenoid coil 90 via the lead 100. An electrical lead 112 extends from the microswitch 52 and light 56 to the source of power through the socket 104. The electrical circuitry which includes the coil 90, the microswitch 52 and the light 56 is the same as that which is disclosed in my copending patent application to which reference has hereinbefore been made, and such circuitry is incorporated herein by reference.

Figure 6:
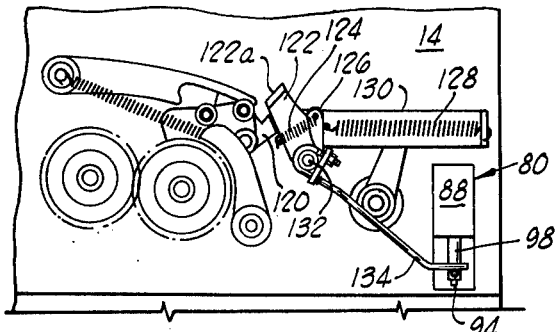
FIG. 6 is a side elevation view of certain details of structure forming a part of the paper feed regulating assembly of the present invention, and showing such structure in its status in which the paper fed regulating assembly is disconnected or released from the mechanism used for incrementally raising the paper feed table in a duplicator of a type under discussion.

A part of the mechanism used for arresting and controlling the movements of the feed table 16 as it is normally caused to occur in the type of duplicating machine here under consideration, is illustrated in FIG. 6. A pawl lever 120 is provided as a part of the feed table elevating mechanism, and undergoes an oscillating movement in correspondence to each increment of elevation of the feed table 16. The structure associated with the pawl lever 120 and cooperating therewith in effecting incremental elevation of the feed table is conventional and well understood in the art. There is generally also provided on duplicating machines of the type under discussion, a pawl latch lever 122 which carries a latching flange 122*a*.

In the operation of this general type of duplicator as heretofore constructed, the pawl latch lever 122 is periodically caused to become disengaged from the pawl lever 120 by the extension of a spring 124 as a regulator plate 126 to which one end of a second spring 128 is secured, is caused to move clockwise by the reciprocating movement of a link assembly 130. The timing of the unlatching or disengagement of the pawl latch lever 122 from the pawl lever 120 is controlled by a mechanical sensing system conventionally provided on duplicators and printing machines of the type under discussion. The mechanical sensing system mechanically senses the level of the top side of the paper stack, and when the lever drops too low, causes the pawl latch lever 122 to be disengaged from the pawl lever 120 to permit the feed table 16 to be elevated in increments until the mechanical sensing system again senses that the paper stack 18 is of proper height. The mechanical linkage then again enables the pawl latch lever 122 to engage the pawl lever 120, and thus to arrest the continuing vertical movement of the feed table. The pawl latch lever 122 pivots on a shaft 132 to which it is keyed. The assembly of the present invention functions to override the normal pivoting movement of the pawl latch lever 122 to retain this lever in engagement with the pawl lever 120 at certain times as controlled by the electro-mechanical sensing system of the invention in a manner described in detail in my copending application Ser. No. 474,975, incorporated herein by reference.

Figure 7:
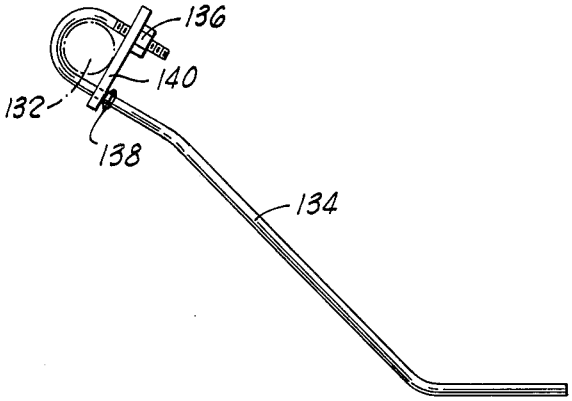
FIG. 7 is a side elevation view of an adapter arm forming a part of the paper feed regulating assembly of the present invention.

An adapter arm 134 has one of its ends resting upon the key 96 of the solenoid assembly 80, and has its opposite end portion bent into a U-shaped configuration (best illustrated in FIG. 7) with the bight thus formed dimensioned to fit closely about the shaft 132. The adapter arm 134 is preferably a stainless steel rod of circular cross-section, and is formed so that the end of the rod located at the U-shaped bend is externally threaded to receive a tap 136. A collar 138 is soldered around the adapter arm at that side of the U-shaped bend opposite the threaded end portion and functions as a stop which contacts one side of a retainer plate 140. The retainer plate 140 has a slot or opening formed therethrough to receive the threaded end of the adapter arm 134, and also receives through a second slot, that portion of the adapter rod which is adjacent the collar 138. The described structure facilitates the quick attachment of the adapter arm to the shaft 132, and the firm retention of this arm on this shaft by threading the tap 136 tightly against the retainer plate 140. It will thus be seen that the pawl latch lever 122 cannot be oscillated about its rotational axis without concurrent pivotation of the adapter arm 134. Thus, the improved adapter arm provided in the present invention functions, in responding to the movements of the solenoid plunger 98, in the same manner as is characteristic of the adapter arm illustrated and described in my copending application.

Figure 8:
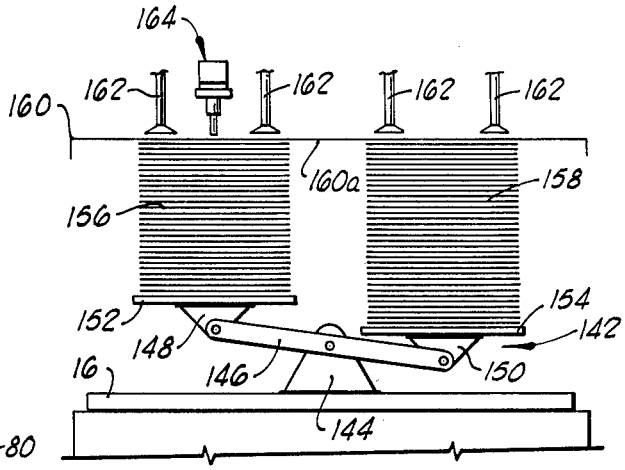
FIG. 8 is a side elevation view of a balance beam subassembly utilized for feeding two stacks of paper stock to a printing or duplicating machine by the two-up method.

A balance beam subassembly 142 which can be advantageously employed in one embodiment of the present invention is illustrated in FIG. 8. The balance beam subassembly includes a fulcrum bracket 144 which is detachably secured to the upper side of the feed table 16. The fulcrum bracket 144 has pivotally secured to the upper portion thereof, an elongated balance beam 146. At its opposite ends, the balance beam 146 is pivotally secured to downwardly projecting pan substructures 148 and 150, which pan substructures are secured to the lower side of stack-supporting pans 152 and 154, respectively. In the use of the balance beam subassembly 150, two stacks of sheets of paper, envelopes, or the like, to be printed are placed upon the pans 152 and 154, and these stacks are represented schematically at 156 and 158 in FIG. 8.

Extending across the duplicating machine above the feed table 16 and supported in the framework superstructure 12 by any suitable means is a paper bale rod 160. The paper bale rod 160 includes a horizontally extending web portion **160*a*. The web portion 160*a* projects across the upper sides of the two stacks of paper 156 and 158 so as to contact the uppermost sheets in the two stacks and retain these sheets in a common horizontal plane which is located so as to establish proper feed to the printing or duplicating machine. A plurality of sucker tubes 162 which function to engage the uppermost sheet of paper in each of the stacks 156 and 158, and to swing this sheet into the printing rollers in conventional fashion, are shown positioned immediately over the two stacks of paper. The microswitch assembly used in the present invention, and hereinbefore described in detail in referring to FIGS. 3 and 4, is illustrated schematically in FIG. 8, and is here designated by reference numeral 164. It will be noted that the downwardly projecting actuator needle of the assembly 164 has its lower end in contact with the uppermost sheet of paper in the stack 156**.

In FIGS. 9–13, there is illustrated a novel receiver-conveyor assembly which is quickly attachable and detachable from presses and duplicating machines for the purpose of receiving printed stock therefrom. The receiver-conveyor assembly is designated generally by reference numeral 168 and is shown in its operative, paper-receiving position in a conventional duplicating machine 170 in FIG. 9. The receiver-conveyor assembly 168 includes a housing, designated generally by reference numeral 170, which housing is of generally right parallelepiped configuration. Thus, the housing is provided with a top wall 174, a pair of opposed side walls 176 and 178 and a removable bottom wall 180. The housing is further closed by a pair of opposed, parallel end walls 182 and 184.

A conventional structure employed on many types of duplicating machines is an elevatable support platform, designated generally by reference numeral 186, which is disposed under the discharge side of the duplicating machine and is provided for supporting or retaining a receiver tray or the like. The elevatable support platform 186 has a horizontally extending upper plate 188 upon which such receiver tray or the like can be rested. The receiver-conveyor assembly 168 of the present invention is shown resting upon the plate 188 after the elevatable support platform 186 has been elevated to its operative, supporting position.

It is also conventional structure on many types of duplicating machines to provide a pair of opposed, substantially parallel, vertically extending side plates 190 and 192 which are positioned on opposite sides of chains which function to move envelopes from the printing rollers within the duplicating machine to the point of discharge therefrom. The plates 190 and 192 function as guard structures preventing inadvertent insertion of the hand of the operator into the moving chains, and also function as guides for aligning and maintaining the position of a receiver tray or the like connected to the press or duplicating machine for receiving the discharged printed stock therefrom. Normally, one of the plates 190 or 192 is a jogger plate, and is operatively connected to moving portions of the duplicating machine so that, during operation of the machine for printing paper stock, such jogger plate is caused to undergo a jogging, reciprocating motion in a direction normal to its major plane, or, stated differently, in a direction which is transverse with respect to the direction of discharge of the paper stock. The purpose of the jogger plate undergoing this motion is to tap the sides of the discharging superimposed sheets of paper or envelopes to maintain them in alignment, and in vertically stacked or overlapped relation. In the drawings of the present application, the side plate 192 is such a jogger plate which, when the duplicator is running, undergoes a reciprocating jogging motion in the direction of the arrow A shown in FIG. 11. The length of this jogging stroke of the jogger plate 192 is not large, and is typically from about one-half to one inch.

Secured to the lower side of the side plate 190 is a key plate 194 which has an arcuate lower surface of generally convex shape. The key plate configuration may further be described as having a semicircular forward side edge which merges with a rear side edge having a gradual upward and rearward taper to the point where this rear side edge merges with a trailing toe **194*a* formed at the rear side of the key plate. The key plate 194 is positioned to cooperate with a receiving slot 196 which is formed in the horizontally extending flange 198 of a latching bracket 200 of L-shaped cross-section. The vertically extending flange 202 of the latching bracket 200 is secured by bolting or other suitable means to the side wall 176 of the housing 172 of the receiver-conveyor assembly 168 as shown in FIGS. 11 and 12**.

Figure 9:
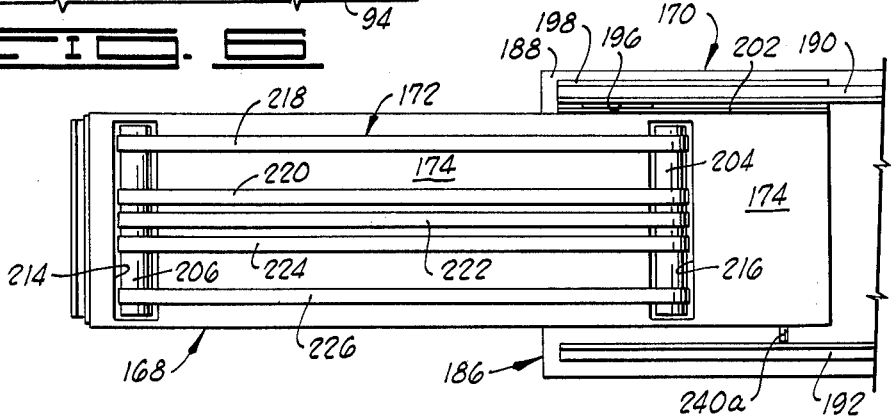
FIG. 9 is a top plan view of a receiver-conveyor table constructed in accordance with the present invention and mounted on the discharge side of a printing or duplicating machine for receiving printed paper stock therefrom.
Figure 10:
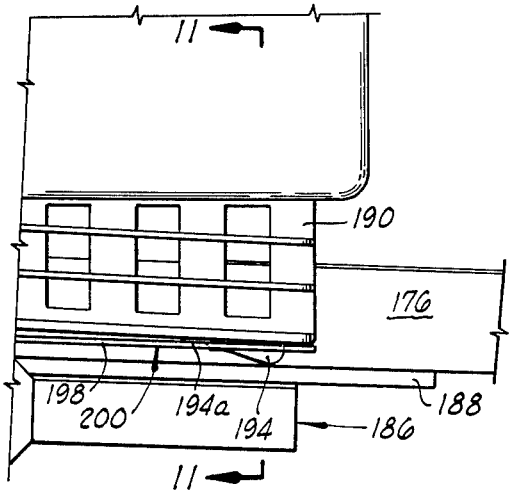
FIG. 10 is a side elevation view of a portion of a duplicator machine near the paper stock discharge side thereof, and showing the manner in which the receiver-conveyor table of the invention is detachably secured in the duplicating machine.
Figure 11:
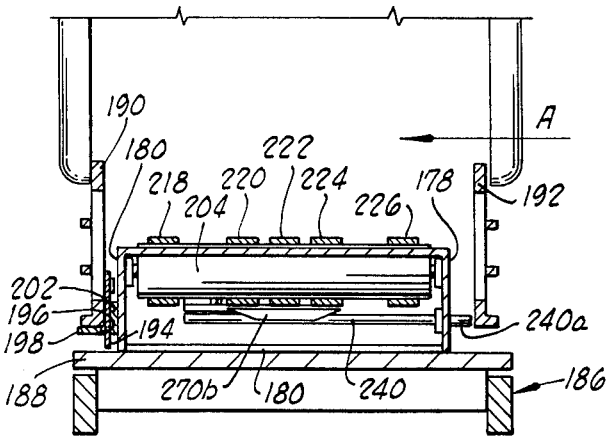
FIG. 11 is a sectional view taken along line 11—11 of FIG. 10.

It will be noted that when the receiver-conveyor assembly 168 is mounted in its operative, paper stock-receiving position as shown in FIGS. 9–11, one end portion of the receiver-conveyor assembly is rested upon the horizontally extending plate 188 and projects into the discharge side of the duplicating machine 170 between the side plates 190 and 192. The receiver-conveyor assembly 168 thus is supported as a cantilever in this position. To maintain the lateral alignment of the housing 172 with respect to the duplicating machine 170, the key plate 194 is engaged with the latching bracket 200 by insertion of the protuberant portion of the key plate through the receiving slot 196 in the horizontally extending flange 198 of this bracket. The trailing toe portion **194*a* of the key plate bears against the unslotted portion of the horizontally extending flange 198 and thus prevents the end of the receiver-conveyor assembly 168** positioned between the side plates 190 and 192 of the duplicating machine 170 from pivoting upwardly when the outer end of the receiver-conveyor assembly becomes loaded with paper stock, envelopes or the like, during operation and in the manner hereinafter described.

Figure 12:
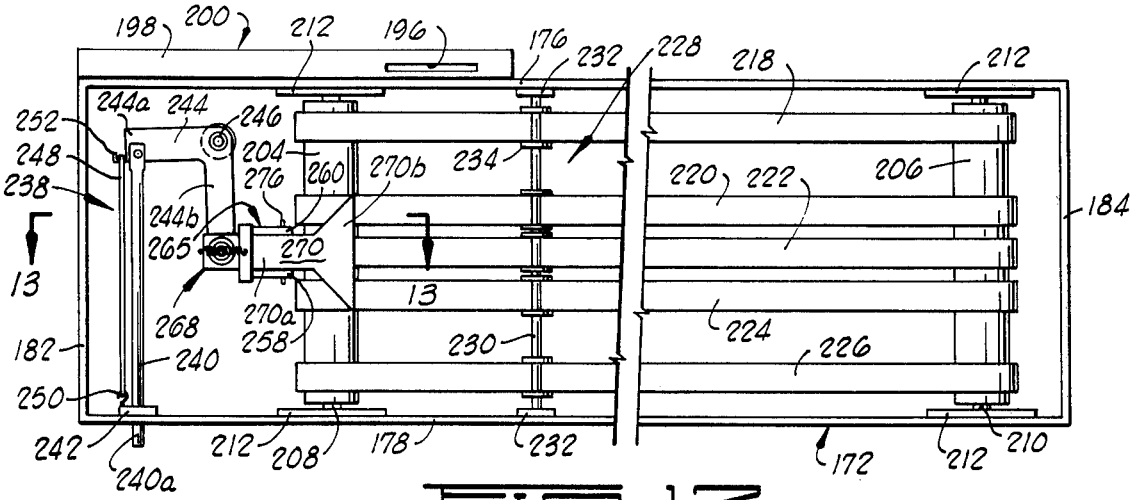
FIG. 12 is a bottom plan view of a receiver-conveyor table of the type depicted in FIG. 9 with a bottom closure plate removed to expose to view the operating mechanism utilized in the receiver-conveyor table.
Figure 13:
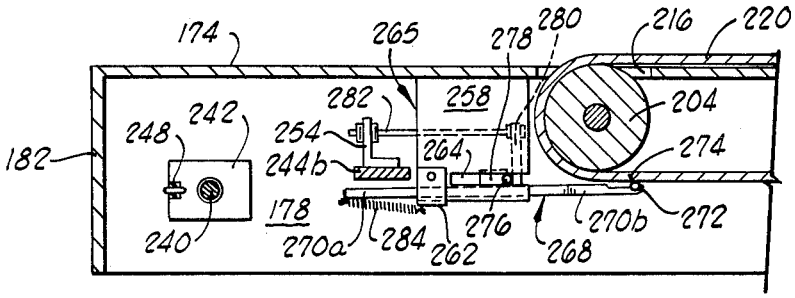
FIG. 13 is a sectional view taken along line 13—13 of FIG. 12.

The details of the operating mechanism of the receiver-conveyor assembly 168 are best illustrated in FIGS. 11–13 of the drawings. As there shown, a pair of belt-supporting rollers 204 and 206 are provided and are keyed to supporting shafts 208 and 210, respectively. The supporting shafts are each rotatably journaled in suitable journal plates 212 secured to the opposite side walls 176 and 178 of the housing 172. It will be noted in referring to FIGS. 9, 11 and 13 that the uppermost portions of the rollers 204 and 206 project through openings 214 and 216, respectively, provided in the top wall 174 of the housing 172. The openings 214 and 216 are horizontally spaced from each other, with the opening 214 being positioned near the outer end of the housing and the opening 216 being spaced from the inner end of the housing. Extending around the roller 204 and 206 are a plurality of continuous flexible belts. In the illustrated embodiment, five of such belts are shown and are denominated by reference numerals 218, 220, 222, 224, and 226. The endless belts 218–226 frictionally engage the rollers 204 and 206 but, as will be hereinafter explained, some slippage of these belts on the rollers is tolerable since, in the novel drive system provided in the receiver-conveyor assembly of the present invention, neither of the belt-supporting rollers 204 or 206 provides the driving impetus for operating the belts during operation of the receiver-conveyor assembly.

Positioned intermediate the length of the belts 218–226, are one or more belt-guiding subassemblies designated generally by reference numeral 228. Each of such belt-guiding subassemblies 228 includes a horizontally extending shaft 230 which extends transversely across the housing 172, and has its opposite ends journaled in a pair of journal plates 232 secured to the opposite side walls 176 and 178 of the housing. The shaft 230 carries a plurality of pairs of guiding disks 234 (see FIG. 12). The pairs of guiding disks 234 are spaced from each other to mate with and guide the belts 218–226 by guiding contact with the opposite side edges of the respective belts. It will be noted in referring to FIGS. 9, 11 and 13 that the upper runs of the several endless belts 218–226 pass over the top side or upper surface of the top wall 176, and that the lower runs of the belts are positioned within the housing 172 and disposed between the top wall 174 and the bottom wall 180 of the housing.

For the purpose of driving certain of the endless belts 218–226 in movement about the belt-supporting rollers 204 and 206, a belt-driving subassembly 238 is provided and is best illustrated in FIGS. 11–13. The belt-driving subassembly includes a reciprocating drive rod 240 which is slidably extended through a bushing 242 secured to the inner side of the side wall 178, and has one end portion 240*a* projecting normal to, and outwardly from, the side wall 178. It will be noted in referring to FIG. 11 that the projected axis of the reciprocating drive rod 240 intersects the lower portion of the side plate 192 which, as has been previously described, is a jogger plate operated in a jogging, reciprocating motion from the moving machinery within the duplicator 170.

The inner end of the reciprocating drive rod 240 is connected to an L-shaped bell crank 244 which is pivotally supported on a suitable pivot post 246 for pivotation about a pivotal axis extending through the angle at the intersection of the arms 244*a* and 244*b* of the bell crank. A suitable spring member 248 is extended between a hook 250 secured to the bushing 242 and a hook 252 secured to, and projecting outwardly from, the end of the bell crank 244. The spring 248 is in tension so as to tend to pull the bell crank 244 in a counterclockwise direction of rotation around its pivotal axis, and to reciprocate the reciprocating drive rod 240 outwardly with respect to the housing 272. The end of the arm 244*b* which is remote with respect to the pivotal axis of the bell crank 244 carries an angle bracket 254 which undergoes oscillating movement with the bell crank 244 during operation of the receiver-conveyor assembly 168 in a manner hereinafter described.

A U-shaped guide element 265 is mounted to the underside of the top wall 174 of the housing so that a pair of opposed, substantially parallel legs 258 and 260 of this element project downwardly in the center of the housing 172 at a location relatively near to the roller 204, and to the three centrally located belts 220–224 which pass around this roller. A spring anchor bar 262 is secured across the lower edges of the legs 258 and 260 of the guide element 256 as shown in FIGS. 12 and 13. Each of the legs 258 and 260 has a horizontally extending slot projected into the leg from the forward side thereof and extending parallel to the lower edge of the respective plate. Such a slot 264 is shown in the plate 258 illustrated in FIG. 13.

An oscillating needle drive structure, designated generally by reference numeral 268, includes a needle-carrying plate 270 which has an elongated stem portion 270*a* and a flared needle head 270*b*. Projecting across the needle head 270*b* on the side thereof adjacent the belts 220–224, is a needle bar 272 (see FIG. 13). The needle bar 272 carries a plurality of needles 274 over its length which are positioned to engage the fabric of which the belts 220–224 is constructed.

A pivot rod 276 is extended transversely across the upper side of the stem portion 270*a* of the needle-carrying plate 270 and has its opposite end portions extending through the slots 264 formed in the legs 258 and 260 of the U-shaped guide element 256. The pivot rod 276 is retained in a fixed position on the needle-carrying plate 270 by a retainer clamp 278 secured to the upper side of the stem portion 270*a* of the needle-carrying plate, and by an upwardly projecting drive plate 280 which is secured to the upper side of the stem portion 270*a* of the needle-carrying plate 270 and extends normal to the plane of the needle-carrying plate. A drive rod 282 is connected between the upper end portion of the upwardly projecting drive plate 280 and the upwardly extending flange of the angle bracket 254 secured to the leg 244*b* of the bell crank 244. Flexible connections are used for connecting the drive rod 282 to the angle bracket 254 and the plate 280 to permit some variation in the angle which the drive rod makes with the flange of the angle bracket and this plate to which it is connected. A friction spring 284 is provided and has one of its ends connected to the spring anchor bar 262 and its other end connected to the end of the stem portion 270*a* of the needle-carrying plate 270.

OPERATION

During the operation of presses and duplicators having the paper feed regulating assembly and receiver-conveyor assembly of the present invention mounted thereon, these units perform functions which can be most clearly described individually and in sequence, and accordingly, the several substructures and subassemblies utilized in the present invention will be accorded individual, in seriatim treatment in the following description of the overall operation of the invention.

PAPER FEED REGULATING ASSEMBLY

Figure 2:
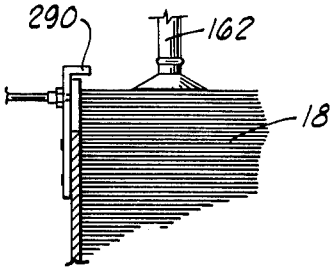
FIG. 2 is a detail view in side elevation of one of the mechanical sensing fingers previously used in some types of duplicating machines.

In preparing the paper feed regulating assembly of the invention for use in the feeding of sheets of paper, envelopes or other paper stock to a printing or duplicating machine, a stack 18 of such paper stock is placed upon the feed table 16 in a predetermined position below the microswitch housing 38 and the sucker tubes 162 as illustrated in FIG. 1. The exposed surface of the uppermost sheet or envelope is positioned such that the suction cups of the sucker tubes 162 will bear flatly against such surface as shown in FIG. 2 of the drawings. In machines which have mechanical sensing systems, including feeler fingers 290 of the type herein shown in FIGS. 1 and 2, these fingers are elevated to a level in the mechanism such that the fingers are inoperative to sense the upper side of the stack of papers or envelopes, and elevation of the feed table is controlled solely by the electro-mechanical regulating assembly of the present invention.

In a duplicating system of the type here being utilized for purposes of illustrating the principles of the present invention, the suction tubes 162, which depend downwardly from a rotatably supported air manifold conduit 202, function to grip the envelope or top sheet of paper at its upper surface, and then, when the air manifold conduit 202 is rotated about its longitudinal axis, to move the top sheet of paper or top envelope into feed rollers to the printing or duplicating mechanism disposed within the frame superstructure.

In commencing the operation of the paper feed regulating assembly of the invention, the microswitch assembly mounted at the end of the elongated plate 26 is manually adjusted in its sensing capability, and in its location over the stack of papers to assure that the upper sheet in the stack 18 will always be at the proper level or vertical position within the machine to assure the most efficient and trouble-free feeding. Adjustment of the microswitch assembly is accomplished by first placing the assembly at a selected location over the top sheet or envelope in the stack 18. The elongated plate 26 is moved transversely with respect to the slide bar 20*c* until the microswitch housing 38 and the actuator needle subassembly 66 are over a portion of the stack at which the top sheet or envelope undergoes relatively little change in its planar alignment or lateral position as the stack is fed upwardly by upward incremental movement of the feed table 16.

Next, the adjusting screw subassembly 40 is utilized to obtain a fine adjustment in the position of actuation of the microswitch 52 by contact of the conically-shaped head 74 of the actuator needle 70 therewith as feeding proceeds. This fine adjustment is accomplished by turning the knurled turning knob 44 to slightly vary the vertical distance which separates the switch housing 38 containing the microswitch 52 from the outer end of the elongated plate 26. This fine adjustment is carried out as a few sheets of paper are fed slowly into the printing mechanism, and is for the purpose of optimizing the location of the contactor plate 60 in relation to the actuator needle 70 so that the response of the microswitch assembly to the location of the top side of the stack of sheets 18 affords the smoothest and most efficient feeding of the sheets to the printing mechanism.

Relatively high speed operation of the duplicator or printing press can now be commenced. The status of the microswitch 52 is normally open. Its closure is effected by the upward movement of the contactor plate 60 when the contactor plate bears against and moves the microswitch contact 54 to close the microswitch. Upward movement of the contactor plate 60 is in turn effected by the reciprocating upward movement of the actuator needle 70, and more specifically, the conically shaped head 74, into contact with the contactor plate. Closure of the microswitch 52 in this manner is ultimately effected by the upward movement of the paper stack 18 as the paper feed table 16 moves upwardly.

Assuming initially that the feeding of the paper is commenced at a time when the microswitch assembly has been adjusted so that the top of the stack 18 of paper application, is high enough to bias the actuator needle 70 upwardly to a switch-closing position, the microswitch is closed at this time and the circuit to the solenoid assembly is also closed, thereby energizing the coil 90 of the solenoid. This results in the solenoid plunger 98 being retracted into the coil. Upward movement of the plunger 98 causes upward movement of that end of the adapter arm 134 which is in contact with the transverse key 96. The adapter arm 134 is thus pivoted about the axis of the shaft 132 and, in the manner described in my copending applicaton, the pawl latch lever 122 is caused to oscillate in a counterclockwise direction to bring its latching flange 122*a* into engagement with the pawl lever 120. The pawl lever 120 is thus locked against oscillation at this time, and this locking engagement prevents the mechanism provided on the duplicator or printing press from elevating the feed table 16.

The top sheets of paper are then fed in sequence by the pivoting sucker tubes 162 through advance rollers and into the printing or duplicating mechanism in a conventional fashion. When a sufficient number of the sheets or envelopes in the stack have been fed to the machine to lower the top of the stack to a point where the actuator needle 70 has moved downwardly out of contact with the contactor plate 60, the latter plate then releases the microswitch contact 54 to permit the microswitch to open. The solenoid assembly 80 is de-energized, permitting the plunger 98 to fall downwardly by gravity until the transverse key 96 is arrested in its downward movement by encountering the lower end of the slot 94 in the plunger limit plate 92. This downward movement of the plunger 98 and transverse key 96 allows the adapter arm 134 to pivot downwardly, and effects the release of the pawl latch lever 122 from the pawl lever 120. The conventional mechanism provided for incrementally elevating the feed table 16 is now free to operate, and the feed table will be moved upwardly in increments as may be necessary to restore the upper level of the stack of paper sheets 18 to a position where the microswitch 52 is again closed to arrest upward movement of the feed table in the manner previously described.

An important feature of the paper feed regulating assembly of the present invention is the ability of the contactor plate 60, due to its length and its flexibility, to override the position of closure of the microswitch 52, and in this way to accommodate the completion of one increment of movement of the feed table 16. In other words, the mechanism which elevates the feed table 16, as it is conventionally provided on most duplicators and printing machines, effects such elevation through a ratchet and pawl stepping mechanism in which the stroke of an oscillating dog or pawl device, in conjunction with a ratchet, effects one increment of vertical movement of the feed table which is correlated to one stroke of the pawl while in engagement with the tooth of the ratchet. To allow this one stroke to be completed without physical damage to the microswitch, the contactor plate 60 can continue to yield in an upward direction even after the microswitch has been closed, and thus permit the incremental movement of the feed table 16 to be completed. This aspect of the construction of the microswitch assembly has the further advantage of reducing the frequency of ON-OFF operation of the microswitch 52 and operation of the feed table 16, so that starting and stopping of these mechanisms does not occur too frequently, since several more sheets must be fed to the printing or duplicating machine before the distorted contactor plate 60 will move downwardly a sufficient distance to permit the microswitch to open.

THE BALANCE BEAM SUBASSEMBLY

When it is desired to operate in a two-up fashion in which two stacks of paper sheets or two stacks of envelopes are fed simultaneously to the printing or duplicating machine, the balance beam subassembly 142 illustrated in FIG. 6 permits this to be accomplished with less frequent malfunction and more efficient feeding than has heretofore been possible. By the placement of the two stacks, 156 and 158, upon the pans 152 and 154 of the balance beam subassembly in the manner illustrated in FIG. 6, a self-compensating action is achieved in which anomalies occurring in either of the two stacks do not result in misfeeding or jamming of the press or duplicating machine. The situation which is illustrated in FIG. 8 is one in which the right hand stack 158 is higher or contains more envelopes or sheets of paper than does the left hand stack. In such a situation, it is important, and in fact necessary, in order to achieve efficient and trouble-free feeding of the press that the horizontal plane occupied by the two top sheets of paper, or the two top envelopes, of the two stacks be in a common plane or, stated differently, that the two top sheets be in perfect horizontal alignment. The ability of the balance beam 146 to pivot on the fulcrum bracket 144 in the manner shown permits this accommodation to be continuously accomplished.

Thus, as the paper feed table 16 is being elevated in the manner hereinbefore described, that stack of papers which either by reason of inherently more compressibility, or by reason of having more sheets in the stack, extends upwardly the highest will initially contact the paper bale rod 160. The upward movement of the top of this stack will be arrested at this time and continued upward movement of the feed table 16 will therefore necessarily be accommodated, insofar as the height of the stack 158 is concerned, by a concomitant downward movement of the pan 154 which supports this stack. Pivoting movement of the balance beam 146 will accommodate this downward movement of the right hand pan 154 carried thereon.

The pivotal movement of the balance beam 146 also has the effect of moving the left hand stack of papers 156 upwardly at a slightly faster rate than the upward movement of the feed table 156 would alone accomplish. Thus, quite quickly, the uppermost sheet in the stack 156 is brought into contact with the paper bale rod 160, and thus the desideratum of having both of the uppermost sheets in the two stacks 156 and 158 aligned in a common horizontal plane is at this instant achieved. As the compressibility of the papers in the two stacks varies with respect to each other, or other anomalies in actual stack height develop, the system provided nevertheless retains the top two sheets or envelopes in each of the two stacks in perfect horizontal alignment so that concurrent feeding proceeds from each of the two stacks in a trouble-free and efficient manner. It will be necessary with a system of the type described to use only one of the microswitch assemblies, as represented schematically by such an assembly 164 located over the left stack 156 as shown in FIG. 8.

RECEIVER-CONVEYOR ASSEMBLY

At the time that the press or duplicating machine is readied for the feeding of sheets of paper stock thereto, the receiver-conveyor assembly 168 of the present invention is mounted at the discharge side of the duplicator machine in the manner depicted in FIGS. 9–13. The end portion of the housing of the receiver-conveyor assembly 168 which carries the belt driving subassembly 238 is inserted between the side plates 190 and 192 of the duplicating machine and the elevating support platform 186 will then be elevated by conventional mechanism provided in such machines until the horizontally extending plate 188 moves into a supporting position immediately beneath the housing 172. At the same time that the housing is placed in the described position, the key plate 194 passes through the receiving slot 196 formed in the horizontally extending flange 198 of the latching bracket 200 and, by reason of its engagement with this slot, prevents lateral or transverse shifting movement of the housing 172 of the receiver-conveyor assembly 168 with respect to the two side plates 190 and 192 of the duplicating machine. Also, by reason of the engagement of the key plate 194 with the receiving slot 196, the trailing toe portion **194*a* of the key plate bears against the unslotted portion of the horizontally extending flange 198 of the latching bracket 200, and thus prevents any tendency of the end portion of the housing 172 positioned inwardly in the duplicator between the side plates 198 and 192** from pivoting or riding upwardly as envelopes or other paper stock move outwardly on the conveyor toward the cantilevered outer end thereof.

With the receiver-conveyor assembly 168 thus mounted on the duplicating machine at the discharge side thereof and between the side plates 190 and 192, it will be noted that the side plate 192, which constitutes a transversely reciprocating jogger, plate is aligned with the projecting end portion **240*a* of the reciprocating drive rod 240 forming a portion of the belt driving subassembly 238 of the receiver-conveyor assembly 168. As the press or duplicator is started up, the jogger side plate 192** commences to undergo a reciprocating jogging motion in a transverse direction indicated by the arrow A in FIG. 11. The frequency of reciprocation of the jogger plate 192 is directly related to, and is synchronized with, the speed of the press or duplicator. As the jogger plate 192 reciprocates, it contacts the reciprocating drive rod 240 and drives this rod inwardly with respect to the housing 172 of the receiver-conveyor assembly 168. During the outward reciprocation of the jogger plate 192, however, the reciprocating drive rod 240 is freed from the driving action of the jogger plate and is returned to its position illustrated in FIG. 11 by the retractive action of the spring member 248.

As the reciprocating drive rod 240 undergoes reciprocation as a result of the opposing actions of the jogger plate 192 and the return spring 248, the bell crank 244 is caused to oscillate in a pivotal motion about a pivotal axis coinciding with the axis of the pivot post 246. This means, of course, that the leg 244*b* of the bell crank undergoes an oscillating movement through an arc, and that the angle bracket 254 also undergoes such oscillating movement.

As the bell crank 244 undergoes oscillation in the manner described, the drive rod 282 is caused to reciprocate along its longitudinal axis, which reciprocating motion can be accommodated by the flexible connection between this drive rod and the angle bracket 254, as well as between the drive rod and the upwardly projecting drive plate 280. Reciprocation of the drive rod 282 is transmitted to the upwardly projected drive plate 280 and, by reason of the connection of this plate to the needle-carrying plate 270, is further transmitted to the latter plate. Thus, as the bell crank 244 undergoes oscillating movement, such movement is transmitted through the intermediate kinematic chain, constituted by the angle bracket 254, the drive rod 282 and the upwardly projecting drive plate 280, to the needle-carrying plate 270.

The needle-carrying plate 270 is mounted between the legs 258 and 260 of the U-shaped guide element 256 and is supported on the pivot rod 276 for pivotation about a horizontal axis. It will be noted in referring to FIG. 13 that as the needle-carrying plate 270 is reciprocated towards the left as there illustrated, two forces act to cause the outer end or right side of the needle-carrying plate 270 which carries the needle bar 272 and needles 274 to move upwardly so that the needles are driven into gripping engagement with the flexible belt 220. The first of these forces is the pull toward the left exerted on the upwardly projecting drive plate 280 by the drive rod 282 tending to cause the needle-carrying plate 270 to pivot in a counterclockwise direction about the axis of the pivot rod 276. The pivot rod 276 can itself, of course, pivot upon the legs 258 and 260 of the U-shaped guide element 256 at those location where it extends through the slots 264 formed in these legs, and the pivot rod can also slide in these slots along their length. The second force which tends to pivot the flared needle head 270*b* upwardly to impale the needles 274 in the fabric of the belt 220 is that which is exerted by the friction spring 284. It will be perceived that as the needle-carrying plate 270 is reciprocated toward the left as it is viewed in FIG. 13, the friction spring 284 is elongated and, by reason of its attachment at one end to the spring anchor bar 262, tends to pull the end of the stem portion 270*a* of the needle-carrying plate 270 downwardly or, stated differently, to cause the needle-carrying plate to pivot in a counterclockwise direction, thus moving the flared needle head upwardly toward the belt 220.

In sum, a reciprocating movement of the needle-carrying plate 270 in a direction toward the left side of FIG. 13 is concurrently accompanied by a pivotal movement of this plate in a counterclockwise direction about the axis of pivotation which coincides with the axis of the pivot rod 276. There thus occurs a concurrent impalement of the needles 274 in the fabric of the belt 220, and a pulling of the lower run of this belt toward the left as viewed in FIG. 13 and a movement of the upper run of the belt toward the right, or more significantly, toward the outer or discharge end of the receiver-conveyor assembly. In this way, the belts 220, 222 and 224 are driven by a reciprocating needle drive which periodically imparts a translational movement to the runs of these three belts and enables them to shift envelopes or sheets of paper which are deposited on these belts upon discharge from the duplicating machine. It will also be recalled that the origination of the drive of the needle carrying plate 270 is at the jogger side plate 192 which, as has been described, is synchronized in its oscillating motion with the speed at which the duplicating machine is operated. Thus, the speed at which the endless belts 220–224 are driven will be directly correlated to the speed at which the press is operated, and importantly, at such time as the press may be shut down or stopped, the driven belts of the receiver-coveyor assembly are also stopped, and no electrical power is wasted or dissipated as a result of a separate or independent drive incorporated in this assembly.

Upon the return stroke of the reciprocating drive rod 240 as effected by the spring member 248, the bell crank 244 is pivoted in a counterclockwise direction, thus driving the needle-carrying plate 270 toward the right as it is viewed in FIG. 13. At this time, two forces act jointly to cause a concurrent pivotation of the needle-carrying plate 270 in a clockwise direction about the horizontal pivotal axis thereof which coincides with the pivot rod 276. First, movement to the right of the drive rod 282, as it is viewed in FIG. 13, applies a moment to the needle-carrying plate 270 through the upwardly projecting drive plate 280, with such moment of force acting in a clockwise direction about the pivot rod 276. This tends to move the flared needle head 270 downwardly and away from the lower run of the belts 220, 222 and 224, and to disengage the needles 274 therefrom.

Concurrently, the tension in the friction springs 284 is reduced as the end of the stem portion 278 of the needle-carrying plate is reciprocated toward the spring anchor bar 262. Thus, the tendency of this spring to pull the end of the stem portion 278 downwardly and pivot the needle-carrying plate 270 in a counterclockwise direction is concurrently reduced. The net effect of the application of these forces is to disengage the needles 274 carried on the flared needle head from the lower run of the belts 220, 222 and 224, to move the flared needle head 270*b* downwardly away from the belt, and to reciprocate the entire needle-carrying plate to the right so that it moves outwardly with respect to the roller 204 and along the lower run of the belts. In this way, the needle-carrying plate is repositioned for another pulling stroke when the direction of reciprocation of the needle-carrying plate is reversed.

As previously pointed out, a significant advantage of the receiver-conveyor assembly 168 of the present invention as compared to those previously in use is that it eliminates the need for a self-contained independently operated motor for driving the belts used to move the envelopes or printed paper stock to the point of discharge on the assembly. Those systems having a self-contained motor drive have often been characterized in having a variable speed arrangement necessitated by the requirement to obtain approximate synchronization between the speed of movement of the belts, and the speed at which the press or duplicator is operated. Using the simple, positive action of the needle drive of the present invention, perfect synchronization is obtained by reason of the origination of the driving force at the jogger plate 192 forming a portion of the press or duplicator and operated in synchronism with the speed of operation of the press.

The receiver-conveyor assembly 168 will receive envelopes or any printed paper stock and convey it, in the sequence of discharge, to an accessible location to be picked up by the press or duplicator operator in a manner which involves no safety hazard, since the pickup point is remote from the press or duplicator. The unique needle drive employed in the receiver-conveyor assembly 168 can positively drive as many of the belts employed in the assembly as may be desired. This type of drive eliminates any need for constant belt tension, such as is necessary where such belts are driven by frictional contact with a driven roller. Changing humidity conditions that normally cause cotton clotch belting to contract or expand, thus requiring sophisticated idler roller tensioning systems, have no effect upon the constancy of the intermittent drive of the receiver-conveyor assembly of the present invention, and it is not necessary to adjust the belt length or tension during the operation of the system. Finally, the receiver-conveyor assembly of the present invention will efficiently accept and deliver envelopes or other printed paper stock delivered by a printing machine or duplicator from a two-up feed arrangement. Many conventional receiver-conveyor units previously marketed cannot be operated as satisfactorily for this purpose as would be desirable.

Although certain preferred embodiments of the present invention have been herein disclosed in order to illustrate the principles employed, and the manner in which these principles are effected to achieve improved press and duplicator operation, it will be understood that many changes of structure can be effected, both in arrangement and form, without departure from these basic principles. All changes and innovations of this type, which do not depart from the basic principles of the invention, are therefore deemed to be circumscribed by the spirit and scope of the invention, except as the same may be necessarily limited by the appended claims or reasonable equivalents thereof.

What is claimed is:

1. An assembly for feeding paper stock to a duplicating machine comprising:
- a paper feed table;
- means for elevating the paper feed table;
- a microswitch assembly spaced vertically from, and disposed over, the paper feed table, said microswitch assembly comprising:
  - a housing;
  - a microswitch mounted in the housing and including a switch contact movable to open and close the microswitch; and
  - a contactor plate mounted in the housing below the microswitch and movable to contact and move the microswitch contact;
- an actuator needle subassembly mounted between the feed table and microswitch assembly and comprising:
  - a tubular member;
  - a sleeve mounted concentrically inside the tubular member; and
  - needle means reciprocably mounted in the tubular member below said contactor plate for vertical reciprocation therein and limited in its downward movement in said tubular member by said sleeve, said needle means being positioned to strike and move said contactor plate upwardly to a switch closing position during upward reciprocating movement and to be contacted by a stack of paper stock supported on said feed table; and
- electro-mechanical means connected to said microswitch and to said means for elevating the paper feed table to activate and inactivate said elevating means when said microswitch is opened and closed.

2. An assembly for feeding paper stock to a duplicating machine as defined in claim 1 wherein said housing has an upper side having a hole in it and a lower side; and wherein said microswitch assembly is further characterized in including:
- a light in said housing and visible through the upper side thereof; and
- an electrical circuit including a portion of said electro-mechanical means, said light and said microswitch.

3. An assembly for feeding paper stock to a duplicating machine as defined in claim 1 wherein said needle means comprises:
- a stem extending through said sleeve and into said tubular member; and
- a conically shaped head connected to said stem and positioned at least partially within said tubular member.

4. An assembly for feeding paper stock to a duplicating machine as defined in claim 1 and further characterized as including:
- a balance beam subassembly mounted on said feed table for concurrently supporting a plurality of stacks of paper thereon.

5. An assembly for feeding paper stock to a duplicating machine as defined in claim 2 wherein the lower side of said housing has a hole therethrough, and said needle means is aligned with the hole in the lower side of said housing for reciprocation therethrough; and
- wherein said contactor plate is pivotally supported on the lower side of said housing and extends across the hole in the lower side of said housing.

6. An assembly for feeding paper stock to a duplicating machine as defined in claim 5 wherein said needle means comprises:
- a stem extending through said sleeve and into said tubular member; and
- a conically shaped head connected to said stem and positioned at least partially within said tubular member.

7. An assembly for feeding paper stock to a duplicating machine as defined in claim 6 and further characterized as including:

a balance beam subassembly mounted on said feed table for concurrently supporting a plurality of stacks of paper thereon.

8. In a printing machine of the type having a vertically reciprocable paper feed table, having suction means for picking up and feeding sheets of paper to a printing mechanism, and having means for incrementally elevating the feed table in the direction of said suction means, the improvement comprising:

supporting bracket means mounted in said machine at a location which is vertically higher than said feed table;

an elongated, substantially horizontally projecting plate movably mounted on said supporting bracket for adjustable positioning over the feed table;

an elongated switch plate having a first end secured to said horizontally projecting plate and projecting from said first end along and directly above said horizontally projecting plate;

an adjusting screw subassembly connected between said switch plate and said horizontally projecting plate for adjusting the distance which separates the second end of said switch plate from said horizontally projecting plate by moving a portion of said switch plate upwardly;

microswitch means carried on the end of said switch plate; and an actuating needle subassembly carried on said horizontally extending plate below said microswitch means and including a needle movable upwardly to a position adjacent said microswitch means upon contact with a vertically moved stack of papers on said feed table, and downwardly away from said microswitch means when papers are removed from the top of said stack.

9. The improvement defined in claim 8 wherein said adjusting screw subassembly comprises:

an internally threaded sleeve on said switch plate; and a threaded screw shank threaded through said sleeve and extending through said switch plate into contact with the upper surface of said horizontally projecting plate.

10. The improvement defined in claim 8 wherein said actuating needle subassembly comprises:

a tubular member having its bore aligned with a hole through said horizontally projecting plate;

an actuator needle movably mounted in said tubular member for reciprocation in said tubular member; and stop means for limiting the downward movement of said needle in said tubular member.

11. The improvement defined in claim 10 wherein said microswitch means comprises:

a microswitch including a contact;

a contactor plate extending across said contact aligned with said needle for cooperation with said needle during the movement thereof to move said contact to close said microswitch.

12. The improvement defined in claim 11 wherein said microswitch means further includes:

a housing having an opening therein;

a light connected to said microswitch and visible through said housing opening; and hinge means pivotally securing one end of said contactor plate to said housing.

13. The improvement defined in claim 11 and further characterized as including:

a feed table;

means for elevating the feed table in increments of vertical travel; and electro-mechanical means interconnecting said microswitch and elevating means for actuating said elevating means when said microswitch is opened.

14. The improvement defined in claim 13 wherein said adjusting screw subassembly comprises:

a vertically extending, internally threaded sleeve positioned over said switch plate and having its lower end in contact with said switch plate; and a threaded screw shank threaded into said sleeve and extending through said switch plate, said screw shank having an end secured to the upper surface of said horizontally projecting plate.

15. The improvement defined in claim 14 wherein said microswitch means further includes:

a housing having an opening therein;

a light connected to said microswitch and visible through said housing opening; and hinge means pivotally securing one end of said contactor plate to said housing.

16. An assembly for incrementally elevating to two vertically extending stacks of paper into a paper sensing and feeding system of a duplicating machine comprising:

a feed table;

means for elevating the feed table in response to a signal from said sensing and feeding means;

means for retaining the uppermost papers in the two stacks in a common horizontal plane spaced vertically above the feed table;

an elongated balance beam pivotally supported on the feed table for pivotation about a horizontal axis above the feed table and extending through the center of the balance beam; and a pair of upwardly facing pans pivotally secured on the opposite ends of the balance beam and positioned to support spaced, vertically extending stacks of paper in a position such that the uppermost paper in each stack contacts said retaining means.

17. An assembly as defined in claim 16 wherein said retaining means comprises a paper bale rod having a web portion extending horizontally at a location spaced above said feed table and directly over said stacks of paper.

18. In a duplicating machine of the type having a vertically reciprocable feed table;

means for picking up and feeding sheets of paper from said feed table to a printing mechanism;

means for incrementally elevating the feed table in the direction of said picking up means;

means for implacing indicia on said sheets of paper in individual sequence;

means for discharging sheets of paper in sequence after implacing the indicia thereon; and reciprocating jogger mean adjacent said discharge means, the improvement which comprises:

a housing;

a pair of spaced belt-supporting rollers rotatably mounted in said housing;

at least one endless belt extended around said rollers and extending under said discharging means;

an oscillating needle drive structure supported in said housing and comprising:

a needle-carrying plate;

needles on said needle-carrying plate; and guide element means secured to said housing and movably supporting said needle-carrying plate in a position adjacent said belt; and driving means mounted in said housing and including:

a drive rod having a portion projecting from said housing in alignment with said jogger means for cooperation with said jogger means; and linkage means interconnecting said drive rod with said needle-carrying plate for reciprocating said needle-carrying plate, said linkage means cooperating with said guide element to oscillate said plate to periodically impale said needles in said belt, and alternately, release said needles from said belt.

19. The improvement defined in claim 18 wherein said guide element means is further characterized as including:

a U-shaped guide element including a pair of opposed, substantially parallel legs; and a pivot rod slidably mounted on said legs and pivotally supporting said needle-carrying plate for pivotation about an axis extending normal to said legs and substantially parallel to the planes occupied by the runs of said endless belts.

20. The improvement defined in claim 19 wherein said linkage means comprises:

a bell crank lever having a first arm connected to said first mentioned to drive rod; and a second drive rod connected between said bell crank lever and said needle-carrying plate for reciprocating said needle-carrying plate and pivot rod on said U-shaped guide element and concurrently pivoting said needle-carrying plate about said axis on said pivot rod when said bell crank lever is pivoted by said first mentioned drive rod.

21. The improvement defined in claim 18 wherein said drive means is further characterized as including a spring attached to said housing and to said drive rod for axially moving said drive rod in one direction after said drive rod has been driven in the opposite direction by said jogger means.

22. The improvement defined in claim 19 wherein said oscillating needle drive structure further comprises:

a drive plate secured to said needle-carrying plate and projecting normal thereto, said drive plate being flexibly connected to said linkage means; and a retainer clamp secured to said needle-carrying plate adjacent said drive plate for cooperating with said drive plate to retain said pivot rod.

23. The improvement defined in claim 18 and further characterized as including a balance beam subassembly mounted on the upper side of said feed table for supporting a plurality of stacks of paper stock.

24. A receiver-conveyor for attachment to a duplicating machine to receive printed papers therefrom comprising:

means for supporting an endless belt in a form to provide an upper belt run and a lower belt run extending parallel to the upper belt run;

an endless belt supported on said supporting mean;

means connected to said supporting means to detachably mount said supporting means to the discharge side of a duplicating machine in a position to receive printed papers on the upper run of said endless belt; and needle drive means movably mounted in said supporting means for intermittent engagement with said belt to alternately engage and pull one of the runs of said belts in a closed circuitous path about said supporting means.

25. A receiver-conveyor for attachment to a duplicating machine to receive printed papers therefrom as defined in claim 24 wherein said supporting means comprises a pair of spaced rollers.

26. A receiver-conveyor for attachment to a duplicating machine to receive printed papers therefrom as defined in claim 25 wherein said means connected to said supporting means comprises a housing rotatably supporting said rollers.

27. A receiver-conveyor for attachment to a duplicating machine to receive printed papers therefrom aas defined in claim 26 wherein said needle drive means comprises:

a needle-carrying plate;

needles on one end of said plate adjacent said belt; and means to oscillate said plate in a combined reciprocating and pivotal motion to sequentially impale said needles in said belt, pull said belt around said rollers and release said needles from said belt.

28. A receiver-conveyor for attachment to a duplicating machine to receive printed papers therefrom as defined in claim 27 wherein said needle drive means further includes a drive rod projecting from one side of said housing and adapted for cooperation with a moving part of said duplicating machine to reciprocate in said housing.

* * * * *

UNITED STATES PATENT OFFICE

CERTIFICATE OF CORRECTION

Patent No. 4,033,576 Dated July 5, 1977

Inventor(s) Jay E. Stanfield

It is certified that error appears in the above-identified patent and that said Letters Patent are hereby corrected as shown below:

Column 2, line 51, change "resilient" to --resultant-- ;

Column 4, line 11, change "contantly" to --constantly-- ;

Column 5, line 18, change "fed" to --feed-- ;

Column 8, line 30, change "lever" to --level-- ;

Column 11, line 21, change "roller" to --rollers-- ;

Column 14, line 27, change "application," to -- sheets --.

Column 17, line 56, change "location" to --locations-- ;

Column 22, line 58, change "mean" to --means-- ;

Column 23, line 31, delete "to" ;

Column 24, line 35, change "aas" to --as-- .

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*